US008879758B2

(12) United States Patent
Yamauchi et al.

(10) Patent No.: US 8,879,758 B2
(45) Date of Patent: Nov. 4, 2014

(54) LOUDSPEAKER, ELECTRONIC APPARATUS USING SAME, AND MOBILE APPARATUS

(71) Applicant: Panasonic Corporation, Osaka (JP)

(72) Inventors: Kenji Yamauchi, Mie (JP); Masatoshi Okuyama, Mie (JP); Satoshi Takayama, Mie (JP); Satoshi Koura, Mie (JP); Shoji Nakajima, Mie (JP); Yachiyo Shimokawatoko, Mie (JP); Hideaki Inoue, Mie (JP); Mitsutaka Enomoto, Nara (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/972,916

(22) Filed: Aug. 22, 2013

(65) Prior Publication Data

US 2013/0336518 A1 Dec. 19, 2013

Related U.S. Application Data

(63) Continuation of application No. PCT/JP2012/001717, filed on Mar. 13, 2012.

(30) Foreign Application Priority Data

Mar. 23, 2011 (JP) ..... 2011-063820
Apr. 14, 2011 (JP) ..... 2011-089882

(51) Int. Cl.
*H04R 25/00* (2006.01)

(52) U.S. Cl.
USPC ..... 381/182; 381/386; 381/395

(58) Field of Classification Search
USPC ..... 381/301, 303, 332–336, 152, 182, 381/386–389, 395, 431
See application file for complete search history.

(56) References Cited

U.S. PATENT DOCUMENTS

| | | | | |
|---|---|---|---|---|
| 8,320,596 | B2 * | 11/2012 | Ishibashi et al. | 381/182 |
| 8,428,293 | B2 * | 4/2013 | Fujise et al. | 381/182 |
| 2006/0034479 | A1 | 2/2006 | Oshika et al. | |

FOREIGN PATENT DOCUMENTS

| | | |
|---|---|---|
| JP | 58-121488 U | 8/1983 |
| JP | 08-223678 | 8/1996 |
| JP | 08-251686 | 9/1996 |
| JP | 2005-079809 | 3/2005 |

OTHER PUBLICATIONS

International Search Report of PCT Application No. PCT/JP2012/001717 dated Jun. 12, 2012.

* cited by examiner

*Primary Examiner* — Suhan Ni
(74) *Attorney, Agent, or Firm* — Panasonic Patent Center

(57) ABSTRACT

A loudspeaker includes a back panel and a plurality of thin loudspeakers mounted onto the back panel. The back panel has an aspect ratio of 6 or higher, and has a wiring unit formed thereon and wire-connecting the thin loudspeakers. The thin loudspeakers are arranged on the back panel in series in a straight line. Accordingly, a thin-type loudspeaker can be realized.

14 Claims, 11 Drawing Sheets

LOUDSPEAKER, ELECTRONIC APPARATUS USING SAME, AND MOBILE APPARATUS

BACKGROUND

1. Technical Field

The technical field relates to a loudspeaker used for various types of video and audio equipment, and to electronic equipment and a mobile device including the loudspeaker.

2. Background Art

Hereinafter, a description is made of conventional video equipment and of a loudspeaker incorporated into the video equipment using the related drawings. FIG. 13 is an external view of the conventional video equipment.

The conventional video equipment includes an image display unit such as a plasma panel and a liquid crystal panel, and loudspeakers 37. As shown in FIG. 13, the conventional video equipment has loudspeakers 37 placed at both sides of the image display unit, and thus each loudspeaker 37 has a vertically long shape. Further, loudspeaker 37 is placed so that its long sides are vertical to the video equipment. Here, loudspeaker 37 is placed with its front side facing in the direction of the front side of the video equipment.

FIG. 14 is a sectional view of the conventional loudspeaker. As shown in FIG. 14, loudspeaker 37 includes enclosure 34 and vertically long slim-shaped loudspeaker 35. Loudspeaker 35 is housed inside enclosure 34. Here, loudspeaker 35 is electrodynamic, cone type. Consequently, the aspect ratio (i.e., the ratio of the length of the shape to its width) of loudspeaker 35 is typically 4 or less.

Slim-shaped loudspeaker 35 includes inner-magnet-type magnetic circuit 44. Magnetic circuit 44 is formed of magnetized magnet 41 sandwiched by upper plate 42 and yoke 43. Magnetic circuit 44 is joined to the bottom of vertically long, slim-shaped frame 46. The circumference of slim-shaped frame 46 has cone-type, slim-shaped diaphragm 47 bonded thereto. Voice coil 48 is joined to the central portion of slim-shaped diaphragm 47 to drive slim-shaped diaphragm 47. Here, voice coil 48 is fixed at the center of slim-shaped frame 46 with damper 49 and is fitted in magnetic gap 45 of magnetic circuit 44.

SUMMARY

In the conventional slim-shaped loudspeaker, the overall height of the slim-shaped diaphragm cannot be lowered, which undesirably increases the thickness of the loudspeaker.

Accordingly, the present disclosure concerns a loudspeaker composed of a back panel, thin loudspeakers, and a wiring unit. The wiring unit wire-connects the thin loudspeakers. Each of the thin loudspeakers is mounted on the back panel having an aspect ratio of 6 or higher. Two or more thin loudspeakers are arranged in series in a straight line on the back panel.

As described above, the loudspeaker has two or more thin loudspeakers connected together, thereby producing sound with a desired sound pressure level even if each of the thin loudspeakers can produce sound with a low sound pressure level. Further, the thin loudspeakers are arranged in series in a straight line, thereby providing a compact loudspeaker thin in thickness and narrow in breadth.

DESCRIPTION OF EMBODIMENTS

Figure 13:
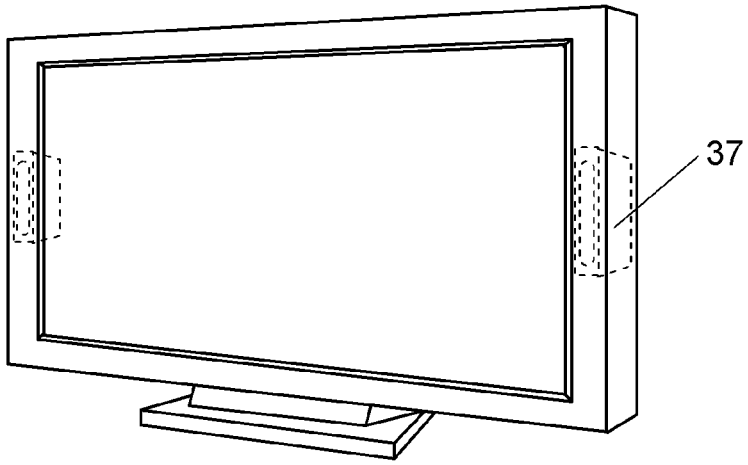
FIG. 13 PRIOR ART
FIG. 13 is an external view of conventional electronic equipment.
Figure 14:
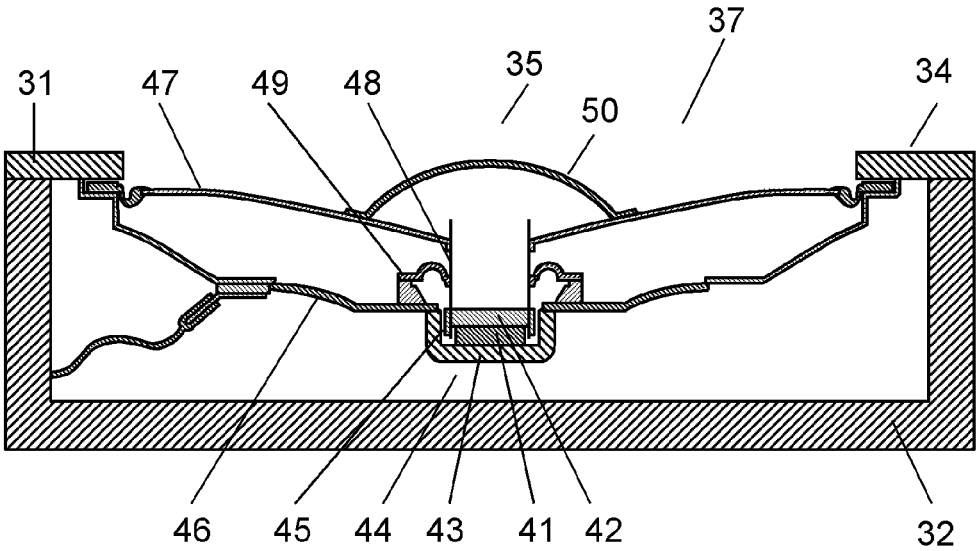
FIG. 14 PRIOR ART
FIG. 14 is a sectional view of a conventional loudspeaker.

A concern regarding the conventional loudspeaker shown in FIG. 13 is reducing the size of the loudspeaker. That is, in order to achieve high input resistance for slim-shaped loudspeaker 35 in the conventional structure, the slim-shaped diaphragm 47 needs to be strengthened, which increases its overall height. In this way, for conventional slim-shaped loudspeaker 35, the overall height of slim-shaped diaphragm 47 cannot be reduced, which undesirably increases the thickness of the loudspeaker. Hereinafter, a description is made with reference to the drawings of a compact loudspeaker according to exemplary embodiments that solves the above-described problem.

First Exemplary Embodiment

Hereinafter, a description is made of a loudspeaker according to the first embodiment.

Figure 1:
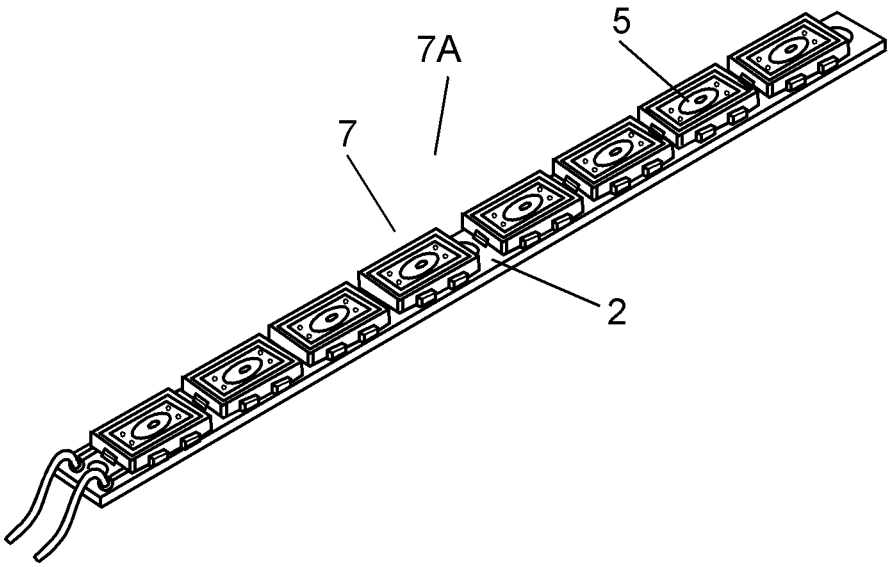
FIG. 1 is a perspective view of a loudspeaker according to a first exemplary embodiment.
Figure 2:
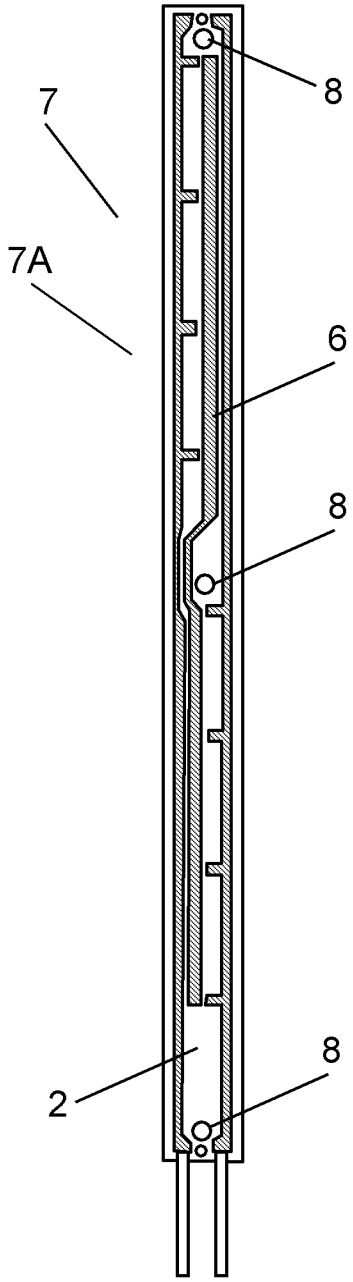
FIG. 2 is a back view of the loudspeaker according to the first exemplary embodiment.

FIG. 1 is a perspective view of loudspeaker 7 according to the first embodiment when viewed from the front surface. FIG. 2 is a back view of loudspeaker 7 when viewed from the back surface.

Thin loudspeaker 5 produces sound with a sound pressure lower than that of an electrodynamic cone loudspeaker having a longitudinal length same as the overall longitudinal length of loudspeaker 7. Further, thin loudspeaker 5 is thinner than the cone loudspeaker.

As shown in FIG. 1, loudspeaker 7 has a plurality of thin loudspeakers 5 mounted to back panel 2. As shown in FIG. 2, back panel 2 has a wiring unit formed thereon for wire-connecting thin loudspeakers 5. Then, thin loudspeakers 5 are arranged on back panel 2 in series in a straight line.

The above-described configuration provides loudspeaker 7 with a desired sound pressure level and desired input resistance by using thin loudspeakers 5 with a low sound pressure level and low input resistance. Further, thin loudspeakers 5 are arranged in series in a straight line, which provides compact loudspeaker 7 thin in thickness and narrow in breadth. In this description, "vertical" refers to the longitudinal direction of loudspeaker 7; "horizontal" refers to the lateral direction.

The wiring unit is formed on the back panel 2. Therefore, point-to-point wiring can be eliminated. According to this configuration, generation of abnormal noise resulting from the wiring contacting other components is prevented, thereby providing loudspeaker 7 with high quality and high reliability. The easy wiring provides favorable productivity and low cost of loudspeaker 7.

Figure 3:
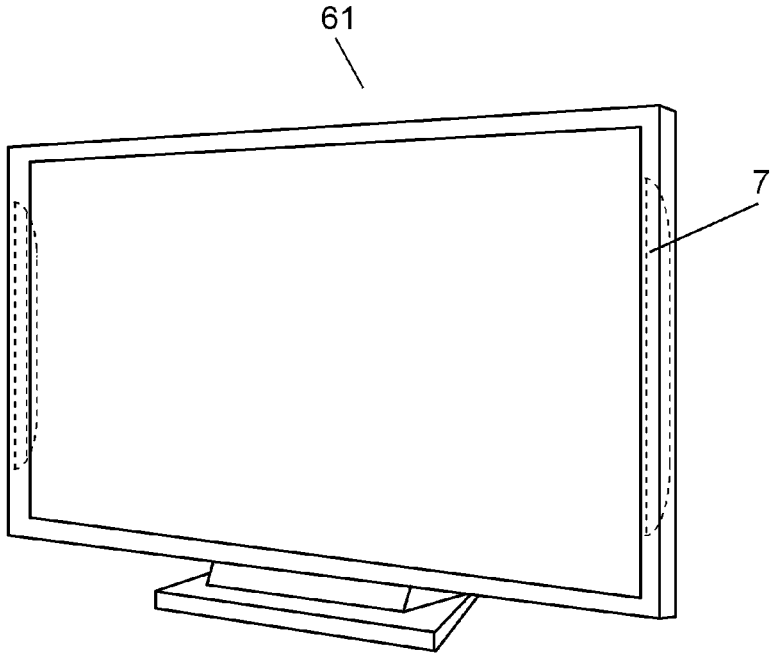
FIG. 3 is an external view of electronic equipment according to the first embodiment.

Hereinafter, a description is made of electronic equipment 61 including loudspeaker 7 according to the embodiment. FIG. 3 is an external view of electronic equipment 61 according to the embodiment. Equipment 61 according to the embodiment has loudspeakers 7 placed near the right and left outer circumferences of the cabinet of electronic equipment 61. Loudspeaker 7 has a long, narrow shape and is placed with its longitudinal direction being vertical.

Loudspeaker 7 may be placed at either one of the vertical outer circumferences of the cabinet of electronic equipment 61. In such a case, however, loudspeaker 7 is placed with its longitudinal direction being lateral, which allows downsizing of electronic equipment 61.

Further, loudspeakers 7 are mounted on the outer circumferential frame of an image display unit, on the right and left and on the top and bottom, if necessary. Such a configuration further increases the input resistance and sound pressure level.

Electronic equipment 61 is provided therein with a signal processing circuit for processing audio signals. The signal processing circuit supplies loudspeaker 7 with signals only in the middle- and high-frequency bands. This configuration, which does not supply loudspeaker 7 with signals in the low-frequency band, allows using the thin loudspeakers with low input resistance. Consequently, a compact loudspeaker with low input resistance can be used as thin loudspeaker 5, which provides further compact and thin loudspeaker 7.

Electronic equipment 61 may be further provided therein with a loudspeaker dedicated to the reproduction of low frequencies. Low-frequency sounds have wide directivity, and thus such a loudspeaker does not need to be placed in front of the video equipment. Hence, the loudspeaker can be placed in an empty space inside the video equipment, which does not prevent downsizing of the video equipment. The signal processing circuit supplies the loudspeaker dedicated to the reproduction of low frequencies with signals in the low-frequency band, which provides electronic equipment 61 capable of reproducing signals in a wide frequency band.

Naturally, small-inch-size video equipment can be used without especially providing a loudspeaker dedicated to the reproduction of low frequencies. However, the number of thin loudspeakers 5 is increased if sounds in the low-frequency band are supplied to loudspeaker 7. Then, connecting thin loudspeakers 5 in parallel lowers the level of signals received by each of the thin loudspeakers, which increases the input resistance of loudspeaker 7.

Hereinafter, a detailed description is made of loudspeaker 7 according to the embodiment. As shown in FIG. 1, loudspeaker 7 as a first example does not include a front panel. Hereafter, loudspeaker 7 of the example is referred to as loudspeaker module 7A.

For loudspeaker module 7A of the present example, eight thin loudspeakers 5 are arranged in series in a straight line. In this example, eight (but not limited to) thin loudspeakers 5 are used; the number of the thin loudspeakers can be freely determined, such as 2, 4, 6, 10, 12, 16, 20, and 30. To sum up, it is adequate if thin loudspeakers 5 are arranged in series in a straight line, where the minimum quantity is two.

The number of thin loudspeakers 5 is determined by the dimensions of the video equipment, the input resistance required for loudspeaker module 7A, and the sound pressure level necessary for satisfying a required sound level.

Further, arranging thin loudspeakers 5 in series in a straight line allows loudspeaker module 7A to be mounted on both sides of the image display unit of the video equipment.

Furthermore, the front panel of loudspeaker 7 can also be used as the front panel of the video equipment in this example. In other words, the front panel of loudspeaker module 7A can be eliminated, thereby slimming down electronic equipment 61.

Back panel 2 of this example is a printed board that is provided with a printed wiring as shown in FIG. 2, which means the wiring unit of the example is a printed one. This configuration eliminates a loudspeaker cord, which allows wiring in a very thin space. Unlike point-to-point wiring of a loudspeaker cord as before, this configuration facilitates slimming down of the loudspeaker module.

Figure 4:
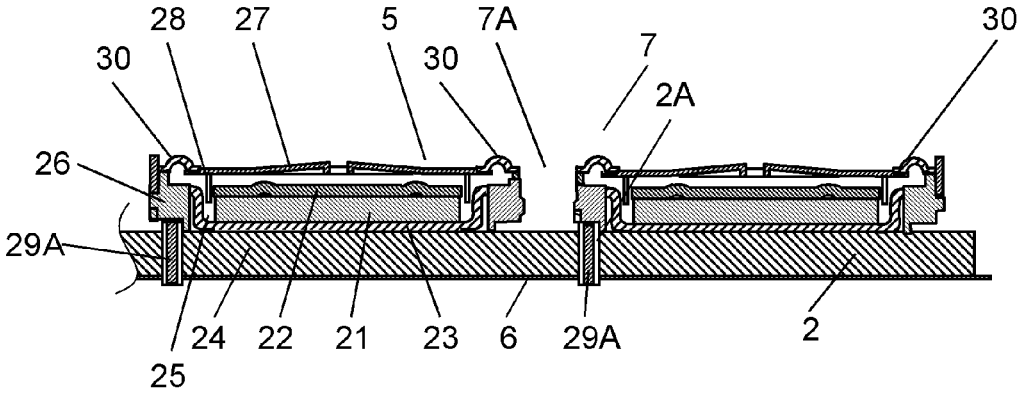
FIG. 4 is an enlarged sectional view of an essential part of the loudspeaker according to the first exemplary embodiment.

FIG. 4 is an enlarged sectional view of an essential part of loudspeaker module 7A according to the embodiment. As thin loudspeaker 5 of the example, a small loudspeaker of a type called micro loudspeaker typically used for a mobile phone. Thin loudspeakers 5 are manufactured in a very large quantity by a dedicated, automated, mass production facility. That is to say, the economies of mass production provides extremely low cost per piece compared to a conventional loudspeaker for video equipment. This prevents the price of loudspeaker module 7A from increasing even if a lot of thin loudspeakers 5 are used, thereby providing loudspeaker module 7A that satisfies the cost requirement of the market (i.e., customers).

Next, a detailed description is made of thin loudspeaker 5 according to the embodiment. In magnetic circuit 24 of thin loudspeaker 5, magnetized magnet 21 is sandwiched between upper plate 22 and yoke 23. Frame 26 made of resin is joined to magnetic circuit 24. The circumference of frame 26 has planar diaphragm 27 bonded thereto. Planar diaphragm 27 has voice coil 28 joined thereto to drive diaphragm 27. Voice coil 28 is joined to a place near the outer circumference of diaphragm 27 and is inserted into magnetic gap 25 of magnetic circuit 24.

Thin loudspeaker 5 can be reduced in overall height due to the absence of a damper as compared to a conventional loudspeaker for video equipment. Diaphragm 27 is not cone-shaped but planar, which further reduces the overall height of thin loudspeaker 5.

Thin loudspeaker 5, however, is smaller in size and overall height than a conventional loudspeaker for video equipment, and so in input resistance. Consequently, loudspeaker module 7A achieves required input resistance by using many thin loudspeakers 5.

Voice coil 28 is enlarged to the maximum and is joined to a place near the outer circumference of diaphragm 27, which provides favorable heat dissipation properties of voice coil 28, thereby increasing the input resistance.

Further, as a result of joining voice coil 28 to a place near the outer circumference of diaphragm 27, the phase in the amplitude at both longitudinal ends of diaphragm 27 can be made equal to the phase of voice coil 28. This decreases distortion of the diaphragm and so of sound, thereby providing loudspeaker module 7A with stable sound pressure-frequency characteristics.

Edge 30 supports diaphragm 27 at the circumference of frame 26. Edge 30 in this example is formed of a highly flexible material that is different from that of diaphragm 27. Further, edge 30 and diaphragm 27 are integrally molded by insert molding, which provides higher input resistance. Furthermore, the sound reproduction band can be expanded toward lower frequencies.

The aspect ratio of thin loudspeaker 5 in the example exceeds 1, which means the vertical outer dimension of thin loudspeaker 5 is larger than the lateral one. Examples of the shape of thin loudspeaker 5 include a rectangle, racetrack shape, and ellipse. This configuration decreases the breadth of loudspeaker module 7A, thereby achieving further slimming down. This increases the space factor of video equipment and saves space of the installation site for loudspeaker module 7A, which allows easy mounting of loudspeaker module 7A on both sides of the image display unit. Especially for rectangular thin loudspeakers 5, they can be efficiently arranged on back panel 2. In this description, "vertical" refers to the longitudinal direction of loudspeaker module 7A; "horizontal" refers to the lateral direction.

In recent years, a rectangle, racetrack shape, and ellipse are becoming the mainstream as the shape of thin loudspeaker 5 used for an information communication terminal such as a mobile phone. Consequently, a thin loudspeaker of such a shape is available inexpensively because of economies of mass production, thereby providing low-cost loudspeaker module 7A.

The outer shape of thin loudspeaker 5 may be round or square, which as well provides the breadth of loudspeaker module 7A smaller than a conventional loudspeaker, thereby achieving slimming down.

Back panel 2 is provided with a wiring unit and the upper surface of panel 2 has thin loudspeakers 5 mounted thereon. In this example, back panel 2 is formed of a printed wiring board, and thus the wiring unit is formed of wiring pattern 6 on the board.

Thin loudspeaker 5 is provided with projection-shaped terminal 29A at the bottom surface thereof. Terminal 29A projects in the direction opposite to that of the acoustic emission from loudspeaker 5. In this example, loudspeaker 5 includes two terminals 29A: positive and negative terminals. Back panel 2 is provided with through holes 2A for insert-fixing terminals 29A. As a result that terminal 29A is inserted into through hole 2A, thin loudspeaker 5 is positioned and simultaneously fixed. In this example, terminal 29A is pin-shaped.

Back panel 2 is provided with wiring pattern 6 on the bottom surface (opposite to the surface on which thin loudspeakers 5 are mounted) thereof. Wiring pattern 6 is wire-connected to terminal 29A projecting from the bottom surface of back panel 2. In this example, wiring pattern 6 is connected to terminal 29A by soldering.

Naturally, connection between wiring pattern 6 and terminal 29A is not limited to soldering, but any connection manner may be used, such as welding, crimping, swaging, and wire wrapping. For instance, the following manner may be used. That is, a conductive part is provided inside through hole 2A, and then pin-shaped terminal 29A is press-fitted into through hole 2A to connect wiring pattern 6 with terminal 29A. In this case, simply inserting terminal 29A into through hole 2A provides electrical connection, which eliminates a separate process for connecting wiring pattern 6 to terminal 29A, thereby increasing the productivity.

The impedance value of loudspeaker module 7A is determined by connection of each of the thin loudspeakers 5 to each other via wiring pattern 6 on back panel 2. In other words, the impedance value can be made to a desired value by appropriately connecting thin loudspeakers 5 to each other in series, parallel, or a combination of them. Consequently, choosing wiring pattern 6 allows the impedance value of loudspeaker module 7A to be easily made to a desired value. Hence, the impedance of loudspeaker module 7A can be easily matched with that of the audio output circuit of the video equipment.

The back surface of thin loudspeakers 5 and back panel 2 are fixed with an adhesive agent, which further increases the strength of connection between back panel 2 and thin loudspeakers 5. This configuration improves the quality and reliability of connection between back panel 2 and thin loudspeakers 5, thereby providing loudspeaker module 7A with high quality and highly reliability.

The back surface of thin loudspeakers 5 is connected to back panel 2 with an adhesive agent having flexibility, where the adhesive agent not only mechanically fixes thin loudspeakers 5 and back panel 2 but also reduces vibration. This configuration prevents the back surface of thin loudspeakers 5 from touching back panel 2 and unusual noise due to resonance from being generated, thereby providing loudspeaker module 7A that reproduces favorable sound with low distortion.

Meanwhile, the back surface of thin loudspeakers 5 and back panel 2 can be fixed with a double-side tape or a gluing agent instead of the adhesive agent. In this case, a double-side tape or a gluing agent is preliminarily applied onto the upper surface of back panel 2. Then, thin loudspeakers 5 are attached to back panel 2, which easily bonds thin loudspeakers 5 to back panel 2, thereby improving the productivity of loudspeaker module 7A.

Back panel 2 in this example is formed of a printed circuit board (what is called a printed board), and thus can be easily manufactured by a common process for manufacturing printed boards, which means back panel 2 is inexpensive and easily available. Meanwhile, back panel 2 also serves as a part of the enclosure of loudspeaker module 7A, which eliminates separately preparing an enclosure that covers the back surface of the loudspeaker module, thereby reducing components for equipment 61. This configuration still further improves the productivity of loudspeaker module 7A and reduces its cost.

Thin loudspeaker 5 may be implemented by, for example, an electrodynamic, small micro loudspeaker, but is not limited to such a configuration. A piezoelectric or electrostatic, small and thin-type loudspeaker may be used, which also provides the same advantage as the electrodynamic, small micro loudspeaker.

Next, a description is made of how to mount loudspeaker module 7A of the example onto electronic equipment 61. Back panel 2 has attaching part 8, which is a mounting hole or notch for instance, where loudspeaker module 7A is screw-fastened at attaching part 8. For loudspeaker module 7A of the example, attaching parts are formed at least at both ends of back panel 2. Then, loudspeaker module 7A is fixed to electronic equipment 61 from its inside.

However, loudspeaker module 7A formed by arranging a number of thin loudspeakers 5 as in the example is vertically long, and thus attaching parts 8 are further provided at the central part of back panel 2, in addition to both ends, which allows loudspeaker module 7A to be securely fixed to electronic equipment 61. Consequently, the central part of loudspeaker module 7A does not touch the cabinet of electronic equipment 61, and thus does not generate chattering noise.

If loudspeaker module 7A is short, or if locking mechanism (e.g., fixing ratchet) that latches at both ends of back panel 2 is provided on the cabinet of electronic equipment 61, for instance, only one attaching part 8 at the central part may be used. This further reduces worker-hours for mounting loudspeaker module 7A onto electronic equipment 61, thereby improving the productivity of electronic equipment 61.

To further improve the productivity, loudspeaker module 7A may be fixed to electronic equipment 61 only with the above-described locking mechanism, where other locking mechanism is not required. This configuration reduces the number of screws as well as worker-hours for tightening screws, thereby providing electronic equipment 61 with low cost and high productivity.

As described above, loudspeaker module 7A of the example allows a plurality of thin loudspeakers 5 all together to be fixed to electronic equipment 61. Unlike a conventional loudspeaker for video equipment, a process for fixing loudspeakers to electronic equipment 61 one by one is eliminated. Consequently, loudspeaker module 7A significantly reduces screws for mounting loudspeakers as well as worker-hours for tightening screws as compared to a conventional loudspeaker, thereby significantly reducing the cost.

Next, a description is made of the outer shape and dimensions of thin loudspeaker 5 and those of loudspeaker module 7A. Loudspeaker modules 7A of this example are placed at both sides of the image display unit of a plasma display panel TV or liquid crystal display TV, and thus the outer shape of loudspeaker module 7A is desirably an elongate rectangle.

Meanwhile, thin loudspeaker 5 is currently used for general purpose applications such as for a mobile phone, and is typically called a small micro loudspeaker. Many thin loudspeakers 5 typically have rectangular outer shapes. Thin loudspeaker 5 of the example is 12 mm or less in the horizontal outer dimension and 13 mm or more in the vertical outer dimension. As a result, a number of thin loudspeakers 5 are arranged vertically in series in a straight line, elongate (i.e., narrow breadth), to form rectangular loudspeaker module 7A. Here, in this description, "vertical" refers to the longitudinal direction of thin loudspeakers 5; "horizontal" refers to its lateral direction.

The outer dimension of typical general-purpose thin loudspeaker 5 used for a mobile phone is approximately 9 mm laterally, approximately 16 mm vertically, and approximately 3 mm thick (i.e., overall height), which is the mainstream. For loudspeaker module 7A formed of eight general-purpose thin loudspeakers 5 arranged in series, the lateral outer dimension of back panel 2 may be typically between approximately 9 mm and approximately 12 mm. Consequently, the lateral outer dimension of back panel 2 (same as the lateral outer dimension of loudspeaker module 7A in this example) can be made to 15 mm or less. In this case, the ratio of the lateral outer dimension of back panel 2 to that of thin loudspeaker 5 may be typically between 1 and approximately 1.25, which means the ratio of the lateral outer dimension of back panel 2 to that of thin loudspeaker 5 can be made to approximately 1.5 or less.

Loudspeaker module 7A of this example is provided with holes or notches, which serve as attaching parts for attaching loudspeaker module 7A to, for example, an electronic apparatus such as a television set. The attaching parts are preferably provided near both ends of loudspeaker module 7A. Accordingly, the vertical outer dimension (same as the vertical outer dimension of loudspeaker module 7A in this example) of back panel 2 including the attaching parts for attaching module 7A to the set is typically approximately 180 mm, which means the dimension can be made to 150 mm or more.

With the above-described configuration, the ratio (hereafter, referred to as aspect ratio) of the vertical outer dimension to the lateral outer dimension of back panel 2 can be made to 10 or more. It is extremely difficult for a conventional, electrodynamic, cone-type loudspeaker to achieve such a high aspect ratio. Hence, loudspeaker module 7A is formed by arranging a plurality of thin loudspeakers 5 in series in a straight line to achieve an aspect ratio too high for a conventional, electrodynamic, cone-type loudspeaker to achieve.

As described above, even if eight thin loudspeakers 5 are arranged in series, the vertical outer shape of loudspeaker module 7A has a length of approximately 180 mm, and thus loudspeaker module 7A can be mounted on small-inch-size video equipment. For instance, a typical 19-inch TV set is approximately 230 mm in height, which means a 19-inch TV set easily contains loudspeaker module 7A formed by arranging eight thin loudspeakers 5 in series.

Such a small-inch-size video equipment is usually used in a relatively small room, and thus the distance between the video equipment and the viewer is relatively short. Accordingly, the input resistance and sound pressure level of loudspeaker module 7A mounted on small-inch-size video equipment may be lower than those of large-inch-size video equipment. Consequently, using eight thin loudspeakers 5 with low input resistance and a low sound pressure level allows loudspeaker module 7A to achieve required input resistance and a required sound pressure level.

Meanwhile, large-inch-size video equipment is placed in a large room, which means the equipment is more distant from the viewer than small-inch-size one. Consequently, loudspeaker module 7A mounted onto large-inch-size video equipment requires high input resistance and a high sound pressure level. Hence, two or more loudspeaker modules 7A are vertically arranged for large-inch-size video equipment. Alternatively, loudspeakers 7 are placed at both vertical parts (upper and lower parts) of the outer frame of the image display unit, thereby increasing the input resistance and sound pressure level.

Consequently, loudspeaker modules 7A can be mounted extensively on nearly all video equipment from small-inch-size one to large-inch-size.

Meanwhile, the overall height of loudspeaker module 7A can be usually made approximately 5 mm even if including the back panel. Therefore, the overall height of loudspeaker module 7A can be 8 mm or less.

The overall height of loudspeaker module 7A can be made extremely small, and thus video equipment including loudspeaker module 7A provides slimming down, downsizing, and space saving that cannot be achieved by a conventional, electrodynamic, cone-type loudspeaker.

Thin loudspeakers 5 originally have favorable sound quality characteristics in the middle- and high-frequency bands. Loudspeaker module 7A is formed by arranging a plurality of thin loudspeakers 5 having such characteristics, thereby producing sound with high articulation and low distortion in the middle- and high-frequency bands. Further, another loudspeaker dedicated to the reproduction of low frequencies incorporated into electronic equipment 61 makes electronic equipment 61 to favorably reproduce sound in the low-frequency band as well.

Back panel 2 includes a wiring unit and thus loudspeaker module 7A does not need point-to-point wiring. The configuration greatly facilitates wiring work. Further, this configuration reliably prevents unusual noise caused by a touch of a wiring with other components, thereby providing loudspeaker module 7A with high quality and highly reliability at low cost.

Thin loudspeakers 5 are available inexpensively because of economies of mass production, thereby providing loudspeaker module 7A that satisfies the cost requirement of customers.

Up to here, the description is made of video equipment as an example of electronic equipment 61. In this case, loudspeaker module 7A has an elongate rectangle shape on the assumption that loudspeaker modules 7A are placed at both sides of the image display unit. However, loudspeaker module 7A of the example can be used as well in a way other than the above.

In the following example, a description is made of a case where loudspeaker module 7A is incorporated into a small-inch-size device such as a small personal computer, game machine, and information-communication device. Such a device is smaller than video equipment such as a plasma display panel TV and a liquid crystal display TV. Thus, loudspeaker module 7A formed by arranging eight thin loudspeakers 5 in series is too large to be incorporated into such a device.

Hence, loudspeaker module 7A of the example is formed of two or three thin loudspeakers 5 arranged in series in a straight line in the longitudinal direction of thin loudspeakers 5.

With such a configuration, back panel 2 of the example may generally have a lateral outer dimension (same as that of loudspeaker module 7A of the example) of approximately 12 mm. Consequently, the lateral outer dimension of back panel 2 can be made to 15 mm or less. Meanwhile, the vertical outer dimension of back panel 2 in the example (same as that of loudspeaker module 7A in the example) may be approximately 75 mm. Therefore, the vertical outer dimension of back panel 2 can be made to 50 mm or more. In this case, the dimension includes that of the attaching parts for attaching module 7A to the set. Hence, loudspeaker module 7A can be incorporated into a device such as a small personal computer, game machine, and information-communication device.

With the above-described configuration, the aspect ratio (same as the aspect ratio of the vertical outer dimension to the lateral outer dimension of loudspeaker module 7A in the example) can be 6 or greater, thereby providing loudspeaker module 7A with a small size and a large aspect ratio while achieving slimming down.

Then, a device, such as a personal computer, game machine, and information-communication device, including loudspeaker module 7A achieves slimming down and downsizing to the extent that a conventional, electrodynamic cone loudspeaker is unable to achieve, thereby further saving space.

Meanwhile, in small electronic equipment 61, loudspeaker module 7A may be installed facing outward. For instance, loudspeaker module 7A may be installed facing the back surface of electronic equipment 61, facing in an angled direction to the back surface, or facing in a direction perpendicular to the image display unit.

Such a configuration further decreases the outer dimension of small electronic equipment 61 viewed from the front direction. Moreover, the configuration improves sound broadening, which is a specific weak point of small electronic equipment 61, thereby adequately achieving stereo effect.

As described above, loudspeaker module 7A of the example is easily mounted onto the outer frame or another part of electronic equipment 61 (e.g., TV set, personal computer, game machine, information-communication device) including an image display unit. Loudspeaker modules 7A are placed at both (right and left) sides of the outer circumferential frame of the image display unit. In this case, the longitudinal side of loudspeaker module 7A is placed on the vertical part of the outer frame of the video equipment, which allows loudspeaker module 7A to satisfy customer request such as downsizing and slimming down of electronic equipment 61.

With the above-described configuration, loudspeaker module 7A presents great advantages of downsizing, slimming down, higher input resistance, high quality, and high reliability while satisfying customer request for cost.

Figure 5:
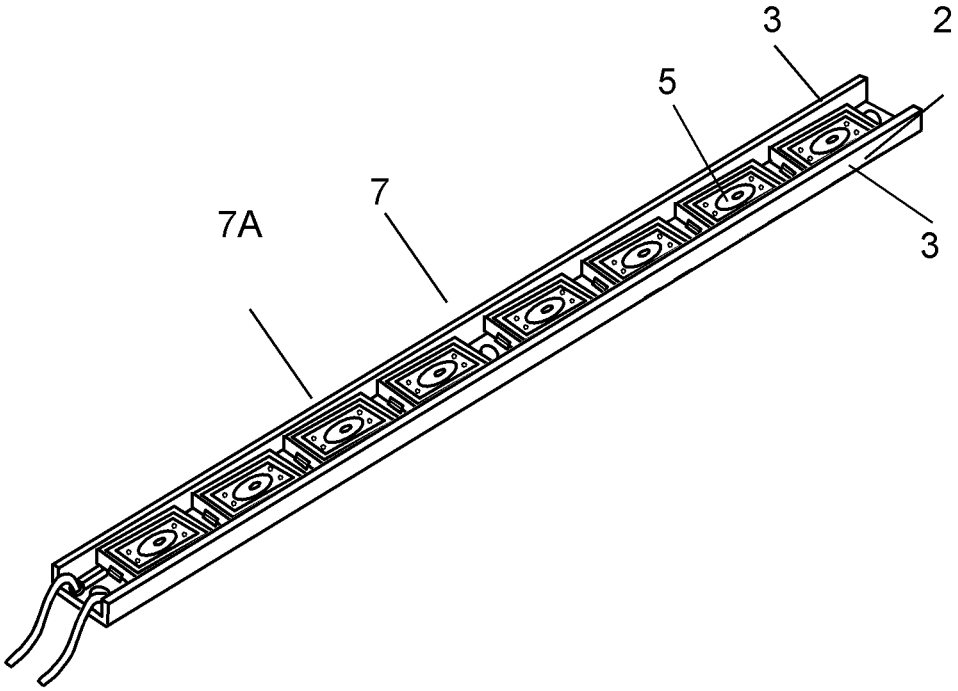
FIG. 5 is a perspective view of a second example of a loudspeaker according to the first embodiment.

Hereinafter, a detailed description is made of loudspeaker 7 of a second example according to the embodiment. FIG. 5 is a perspective view of a loudspeaker of a second example according to the first embodiment. As shown in FIG. 5, loudspeaker 7 of the second example has side panels 3 formed at both lateral ends of back panel 2 of loudspeaker module 7A of the first example.

Back panel 2 and side panels 3 are integrally formed of a same material, thereby allowing highly productive manufacturing. Further, the configuration provides high dimensional accuracy between side panels 3. This configuration makes side panels 3 function as a guide for mounting thin loudspeakers 5 in place onto back panel 2, thereby increasing the accuracy of the position for mounting the thin loudspeakers and improving production efficiency.

Further, the outer dimension of thin loudspeakers 5 in the lateral direction is roughly the same as the internal diameter of the two side panels 3, which allows positioning thin loudspeakers 5 with a high degree of accuracy, thereby providing loudspeaker module 7A free from chattering (backlash) of thin loudspeakers 5.

Furthermore, back panel 2 and two side panels 3 are integrally formed, which prevents unusual noise from being generated that is caused by a contact of back panel 2 with two side panels 3. Moreover, air does not leak at the joints between back panel 2 and side panels 3, and naturally side panels 3 are not detached from back panel 2, resulting in high strength of connection between side panels 3 and back panel 2. This configuration provides loudspeaker module 7A with stable quality and high reliability.

Back panel 2 and side panels 3 also serve as a part of the enclosure of loudspeaker module 7A. Therefore, it is not necessary to separately prepare an electronic enclosure that covers the back surface and side surface of the loudspeaker module, thereby reducing component materials for electronic equipment 61. This configuration improves the productivity of loudspeaker module 7A and reduces its cost.

Hereinafter, a detailed description is made of loudspeaker 7 of a third example according to the embodiment. This loudspeaker 7 has enclosure 4. Hereafter, loudspeaker 7 of the example is referred to as loudspeaker system 7B.

Figure 6:
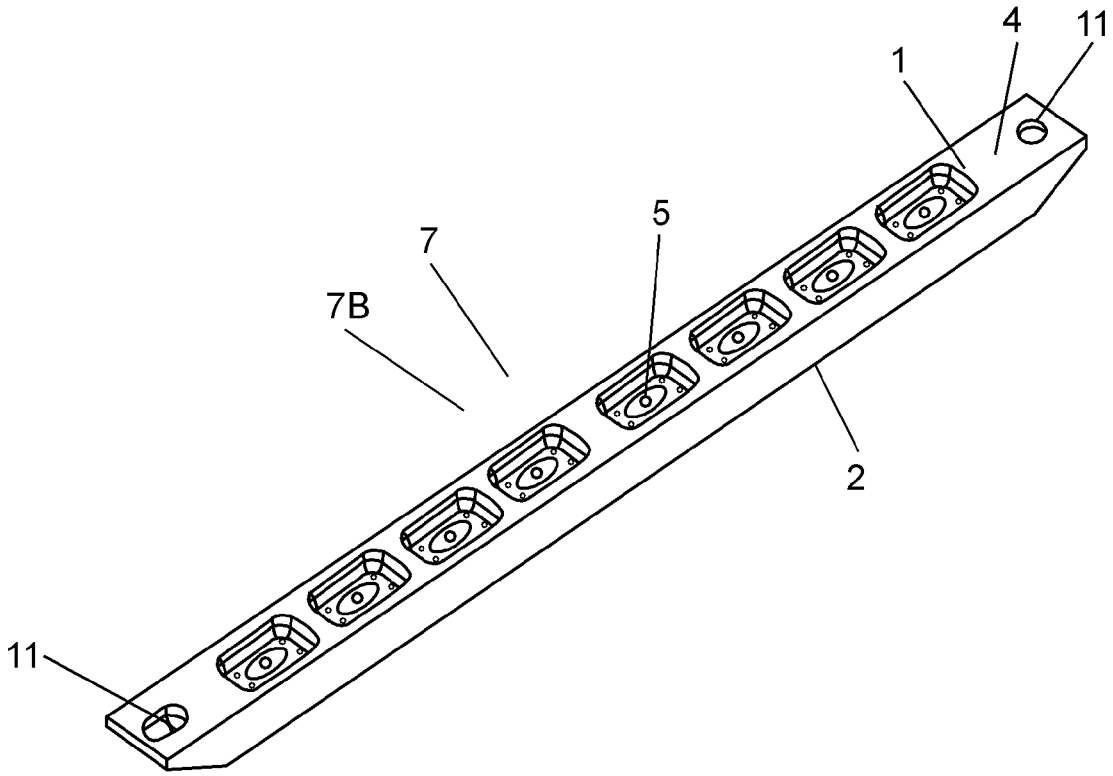
FIG. 6 is a perspective view of a third example of a loudspeaker according to the first embodiment.
Figure 7:
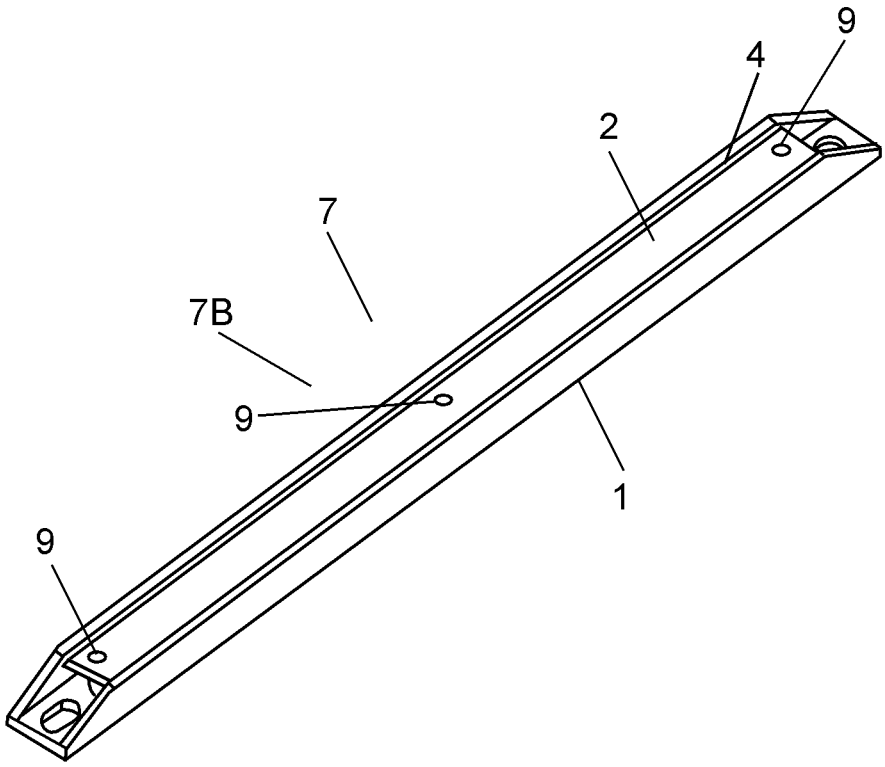
FIG. 7 is a rear perspective view of the third example of the loudspeaker according to the first embodiment.

FIG. 6 is a perspective view of a loudspeaker of the third example according to the embodiment. FIG. 7 is a rear perspective view of the loudspeaker of the third example according to the embodiment. In these drawings, components same as those in FIGS. 1 through 5 are given the same reference numbers as those in the figures.

Hereafter, a description is made of loudspeaker 7 of the third example, mainly about parts different from the loudspeaker of the first example. Enclosure 4 of loudspeaker system 7B is formed of front panel 1 and back panel 2.

In this example, side panels 3 are provided on the widthwise outer circumferential ends of front panel 1. Two side panels 3 are formed integrally with front panel 1. Therefore, unusual noise caused by contact of front panel 1 with side panels 3 is prevented, and air leakage is not generated. Further, side panels 3 do not cause a quality defect such as being detached from front panel 1, thereby providing loudspeaker system 7B with high strength, and stable quality and reliability.

In this example, the top surface of back panel 2 has wiring pattern 6 formed thereon for wire-connecting thin loudspeakers 5. Meanwhile, the backside of thin loudspeaker 5 is provided thereon with terminal 29B having elasticity. Each wiring pattern 6 is formed on a position corresponding to the terminal when respective thin loudspeaker 5 is attached to back panel 2.

Next, a description is made of how to produce loudspeaker system 7B of this example. Preliminarily, front panel 1 and side panels 3 are assembled, bonded, and integrated. In this example, front panel 1 and side panels 3 are formed as separate components. In this case, they can be made of different materials. For example, when the widthwise outer dimension of loudspeaker system 7B is desired to be smaller, side panels 3 are made of metal plates. Meanwhile, when the outer dimension of loudspeaker system 7B in the thickness direction is desired to be smaller, front panel 1 is formed of a metal plate. In this way, an appropriate material can be chosen according to desired length and shape.

Of course, front panel 1 and side panels 3 may be integrally formed. For example, both of them may be formed of a metal plate. In this case, side panels 3 can be formed by being bent from front panel 1. Also, they may be integrally molded with resin. In any case, such a configuration eliminates a process for assembling front panel 1 and side panels 3, thereby providing loudspeaker system 7B with high productivity and low cost.

Figure 8:
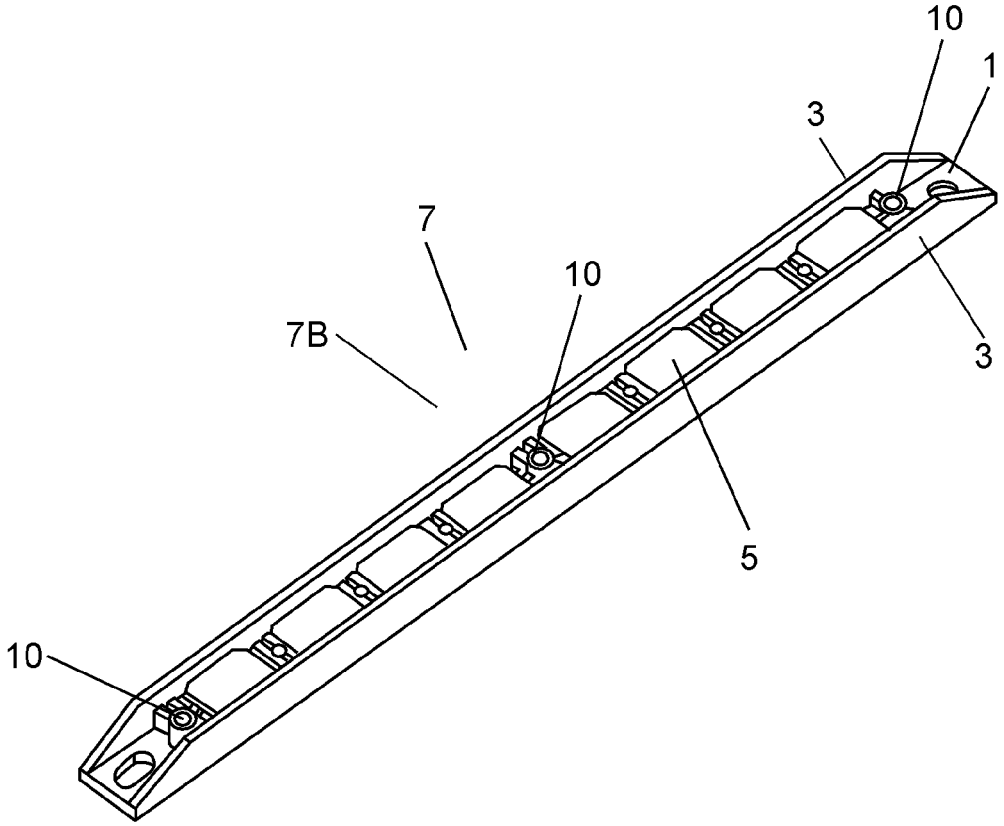
FIG. 8 is a perspective view of the third example of the loudspeaker in its production process according to the first embodiment.
Figure 9:
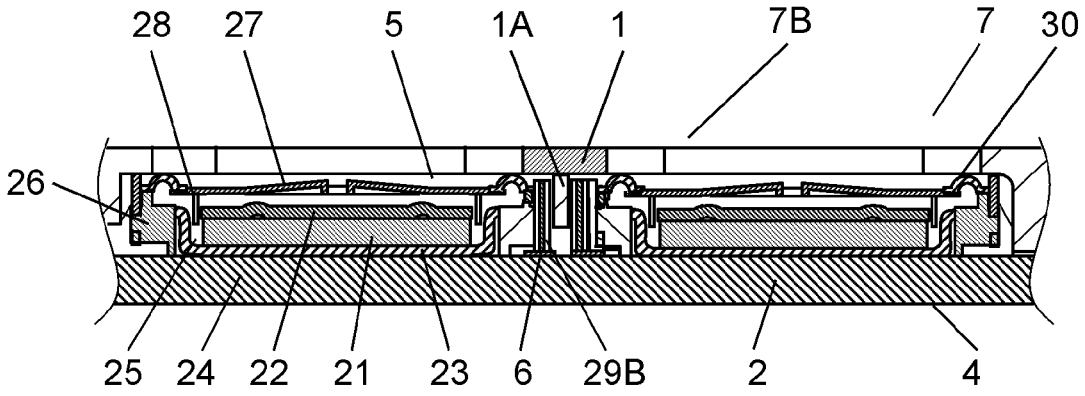
FIG. 9 is an enlarged sectional view of an essential part of the third example of the loudspeaker according to the first embodiment.

FIG. 8 is a perspective view of a loudspeaker of the third example according to the embodiment in its production process. FIG. 9 is an enlarged sectional view of the essential part the loudspeaker of the third example according to the embodiment. After the process of producing an integrated component of front panel 1 and side panels 3, thin loudspeakers 5 are mounted onto front panel 1 guided by side panels 3. Therefore, accuracy of the lateral position of the thin loudspeakers is favorable. In this example, the backside of front panel 1 is provided thereon with partitioning projection 1A. Projection 1A regulates the vertical position of each of mounting thin loudspeakers 5. Projection 1A also reduces interference between sounds generated by adjacent thin loudspeakers 5, which allows thin loudspeakers 5 to be arranged close to each other, thereby providing loudspeaker system 7B with favorable sound quality in spite of its small size.

After the process of mounting thin loudspeakers 5 onto front panel 1, back panel 2 and front panel 1 are assembled. Then, they are fixed by, for example, screw fastening to complete loudspeaker system 7B.

In loudspeaker system 7B thus assembled, terminal 29B contacts wiring pattern 6 by an elastic force of itself caused by pressurization, which makes terminal 29B press-contact wiring pattern 6, thereby electrically connecting between thin loudspeakers 5 and wiring pattern 6 on back panel 2. In other words, thin loudspeakers 5 and back panel 2 are connected with spring contact. This configuration eliminates a process (e.g., soldering) for connecting thin loudspeakers 5 and back panel 2. Therefore, worker-hours for assembling loudspeaker system 7B are reduced, thereby providing loudspeaker system 7B with favorable productivity.

With terminal 29B having elasticity provided, thin loudspeakers 5 are fixed in a state where they are being pressed toward front panel 1. Consequently, terminal 29B fixes thin loudspeakers 5 and electrically connects thin loudspeakers 5 to wiring pattern 6. Further, the configuration prevents unnecessary resonance in components such as front panel 1, thin loudspeakers 5, and back panel 2, thereby providing acoustically stable loudspeaker system 7B.

Further, thin loudspeakers 5 of this example are sandwiched between front panel 1 and back panel 2. Hence, when back panel 2 is attached to front panel 1, terminal 29B is pressurized. Consequently, terminal 29B press-contacts wiring pattern 6 and simultaneously thin loudspeakers 5 press-contact front panel 1 by an elastic force of terminal 29B. In other words, front panel 1 and back panel 2 are assembled, and simultaneously thin loudspeakers 5 are fixed and electrically connected to wiring pattern 6. This configuration eliminates separate processes of fixing thin loudspeakers 5 and electrically connecting between thin loudspeakers 5 and wiring pattern 6, thereby providing loudspeaker system 7B with high productivity.

The elasticity of terminal 29B causes thin loudspeaker 5 to be fixed to front panel 1 in a state where loudspeaker 5 is being pressed against front panel 1. Therefore, unnecessary resonance in components such as front panel 1, thin loudspeakers 5, and back panel 2 is prevented, thereby providing acoustically stable loudspeaker system 7B.

Both ends of back panel 2 of the example are provided with screw holes 9 for fixing the front panel. On the other hand, the backside of front panel 1 is provided thereon with bosses 10 at the positions corresponding to screw holes 9. Herewith, front panel 1 and back panel 2 are screw-fastened at two positions of both ends of back panel 2. Since loudspeaker system 7B of the example can be extremely thin, front panel 1 and back panel 2 are fixed with adequate stability by being screw-fastened at only two positions at both ends of back panel 2.

In this example, screw hole 9 is further provided in the central part of back panel 2. On the other hand, boss 10 is further provided at the central part of the backside of front panel 1. Then, front panel 1 and back panel 2 are screw-fastened at the central part as well. This configuration reduces warpage of back panel 2 caused by an elastic force of terminal 29B, which increases an elastic force of terminal 29B at the central part, thereby providing favorable reliability of connection between thin loudspeakers 5 and wiring pattern 6.

When it is desired to increase the productivity, front panel 1 and back panel 2 are fixed at one position of the central part. On the other hand, if loudspeaker system 7B is vertically very long, it is adequate to increase as appropriate positions where front panel 1 and back panel 2 are fixed, for instance to three positions i.e., both ends for fixing front panel 1 and back panel 2 and the central part.

To further increase the productivity, front panel 1 and back panel 2 may be fixed with locking mechanism instead of screw fastening. In this case, locking mechanism is provided on front panel 1 and back panel 2, and they are fixed by press-fitting, thereby decreasing screws and further improving productivity.

Figure 10A:
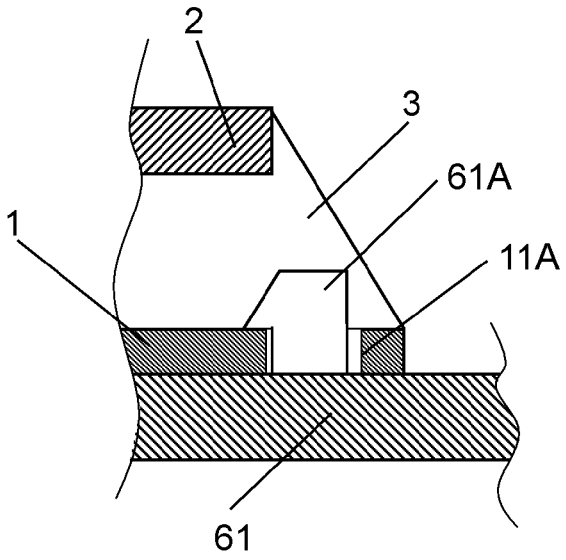
FIG. 10A is an enlarged sectional view of an essential part of electronic equipment including an attaching part of the third example of the loudspeaker according to the first embodiment.

FIG. 10A is an enlarged sectional view of an essential part of electronic equipment including an attaching part for loudspeaker system 7B according to the embodiment. In loudspeaker system 7B of the example, attaching parts 11A for mounting system 7B to electronic equipment 61 are preferably provided near both ends of front panel 1 as shown as attaching parts 11 in FIG. 6, and thus front panel 1 is longer than back panel 2. Attaching parts 11A are holes or notches formed near both ends of front panel 1, for instance. In this case, fixing projection 61A formed on electronic equipment 61 is press-fitted into attaching part 11A to fix loudspeaker system 7B to electronic equipment 61. Further, a ratchet provided on the tip of fixing projection 61A formed on electronic equipment 61 is hooked into attaching part 11A to fix loudspeaker system 7B to the electronic equipment. This configuration eliminates a screw fastening process when loudspeaker system 7B is fixed to electronic equipment 61.

Figure 10B:
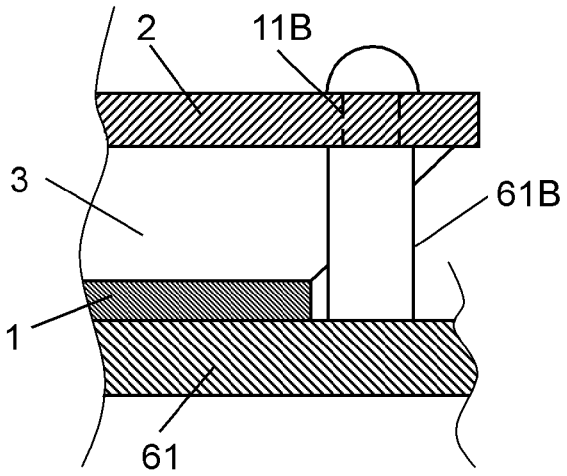
FIG. 10B is an enlarged sectional view of an essential part of electronic equipment including another attaching part of the third example of the loudspeaker according to the first embodiment.

FIG. 10B is an enlarged sectional view of an essential part of electronic equipment including an attaching part of another example of loudspeaker system 7B according to the embodiment. In this case, attaching part 11B for mounting loudspeaker system 7B to electronic equipment 61 is formed at back panel 2, as same as loudspeaker module 7A of the first example. The surface to be the inner side of the cabinet of electronic equipment 61 is provided thereon with boss 61B for screw-fastening loudspeaker system 7B. In this case, however, front panel 1 is made shorter than back panel 2, which makes loudspeaker system 7B be securely fixed to electronic equipment 61 owing to screw fastening, thereby preventing unusual noise caused by a contact of loudspeaker system 7B with electronic equipment 61.

Loudspeaker system 7B of the example does not necessarily require attaching part 11A or 11B. For example, electronic equipment 61 is provided with a spring for fixing loudspeaker system 7B at a position to be the rear of loudspeaker system 7B. In this case, the spring presses loudspeaker system 7B toward the inner side of the cabinet at the front surface of electronic equipment 61, which allows loudspeaker system 7B to be directly pressed against the inner side, thereby reducing the front chamber effect on sound emitted from loudspeaker system 7B.

Loudspeaker system 7B can be composed of an assembly of front panel 1 and two side panels 3, and loudspeaker module 7A of the first example. Alternatively, loudspeaker system 7B can be composed of front panel 1 and loudspeaker module 7A of the second example, where attaching part 8 may be used as screw hole 9.

Figure 11:
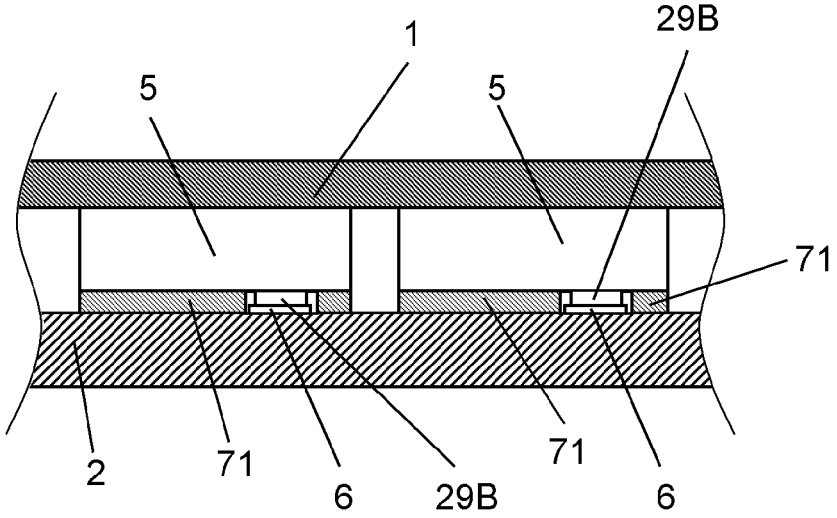
FIG. 11 is an enlarged sectional view of an essential part of a fourth example of a loudspeaker according to the first embodiment.

FIG. 11 is an enlarged sectional view of the essential part of a loudspeaker of a fourth example according to the first embodiment. As shown in FIG. 11, cushion 71 is provided between thin loudspeakers 5 and back panel 2. As thin loudspeakers 5 are sandwiched between front panel 1 and back panel 2, cushion 71 is sandwiched between thin loudspeakers 5 and back panel 2. According to the arrangement, pressurizes cushion 71 is compressed, and its elastic force presses thin loudspeakers 5 toward front panel 1. Consequently, the front surface of thin loudspeakers 5 press-contacts the backside of front panel 1 with an even force, which allows thin loudspeakers 5 to closely contact front panel 1 evenly. This prevents air leakage from a portion between thin loudspeakers 5 and front panel 1, and unusual noise caused by a contact of thin loudspeakers 5 with front panel 1. Further, the configuration prevents unnecessary resonance in components such as front panel 1 and back panel 2, thereby providing acoustically stable loudspeaker system 7B.

Second Exemplary Embodiment

Hereinafter, a description is made of a second exemplary embodiment.

Figure 12:
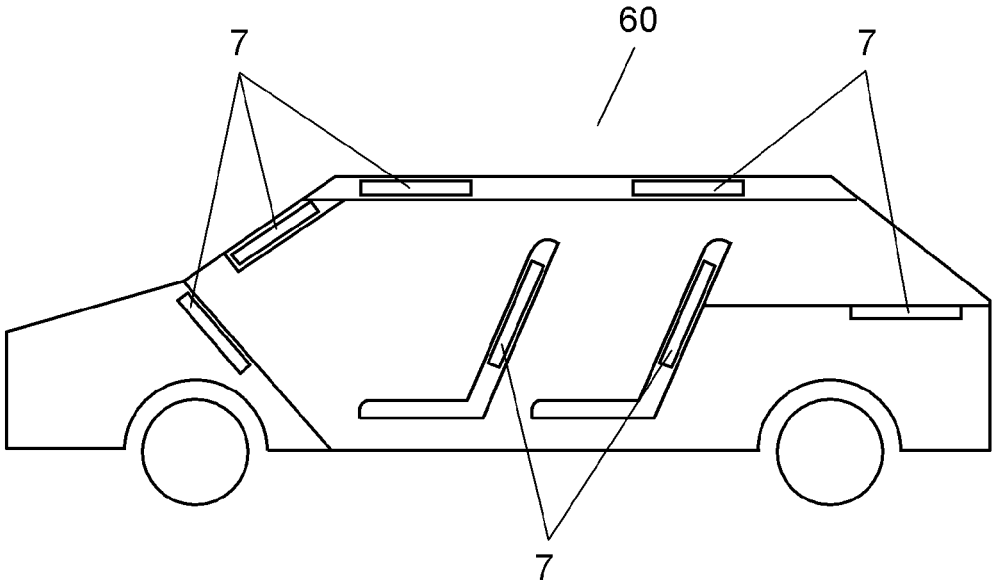
FIG. 12 is a sectional view of a mobile device according to the first embodiment.

FIG. 12 is a conceptual diagram of a mobile device according to the second embodiment, where an automobile is used as an example of the mobile device. Main body 60 (e.g., a ceiling, instrument panel, sun visor, seat, rear tray and the like) of the automobile has loudspeakers 7 incorporated thereinto. Loudspeakers 7 are used as part of a car audio system and/or a car navigation system. Loudspeaker 7 according to the embodiment may be a loudspeaker of whichever example according to the first embodiment.

Loudspeaker 7 may be installed to a place other than the above, such as a headrest, arm rest, cockpit, mirror, meter, steering wheel, pillar, and door. Loudspeaker 7 of this embodiment is extremely small and thus can be easily installed at any place.

It is preferable that a loudspeaker is installed close to ears, and thus a front pillar is an appropriate position for placing loudspeaker 7. Loudspeaker 7 has a long and thin shape, which does not influence on the width of the front pillar even if it contains loudspeaker 7. Consequently, the width of the front pillar can be small even if it contains loudspeaker 7, thereby providing a mobile device with a favorable view from the driver.

Loudspeaker 7, placed near ears, allows a user to adequately feel the sound pressure for a relatively low level of loudspeaker 7, and thus thin loudspeaker 5 can be formed of a micro loudspeaker with a low sound pressure level.

The foregoing configuration promotes downsizing of a mobile device such as an automobile. The configuration also achieves weight reduction, which contributes to reducing fuel consumption of the mobile device.

Further, loudspeaker 7 has a high acoustic articulation in the middle and high-frequency bands and provides sound with low distortion. Hence, if a separate loudspeaker dedicated to the reproduction of low frequencies is provided in electronic equipment 61, sound in the low-frequency band can also favorably be reproduced. This configuration creates a comfortable acoustic space in the automobile.

Furthermore, as loudspeaker 7 has a wiring unit on its back panel, point-to-point wiring inside loudspeaker 7 is not necessary. Since such loudspeaker 7 is mounted on the mobile device, loudspeaker 7 does not generate uncomfortable noise even if loudspeaker 7 undergoes vibration during travelling, thereby allowing loudspeaker 7 to be installed near ears of a user.

In this embodiment, the description is made of a case where loudspeaker 7 is incorporated into automobile 60, but not limited to the case. For example, loudspeaker 7 can be incorporated into any device as long as it is a mobile device such as a bicycle, motorcycle, bus, train, shipping craft, and aircraft.

What is claimed is:

1. A loudspeaker comprising:

a back panel having an aspect ratio of 6 or higher;

a front panel forming an enclosure together with the back panel;

thin loudspeakers attached to the back panel and disposed in series in a substantially straight line; and a wiring unit disposed on the back panel and wire-connecting the thin loudspeakers, wherein each of the thin loudspeakers has an outer shape of one of a rectangle, a racetrack shape, and an ellipse, and each of the thin loudspeakers includes:

a frame;

a magnetic circuit connected to the frame and provided with a magnetic gap therein; a diaphragm attached to a periphery of the frame; and a voice coil having a first end connected to an outer periphery of the diaphragm and a second end disposed in the magnetic gap, wherein the thin loudspeakers are fixed by being sandwiched between the front panel and the back panel, wherein the wiring unit is a printed wiring, and wherein the loudspeaker includes a terminal that is placed in a direction opposite to a direction of acoustic emission from the thin loudspeakers and has elasticity to press-contact the printed wiring and the thin loudspeakers are pressed toward the front panel by an elastic force of the terminal.

2. The loudspeaker according to claim 1, wherein the wiring unit is a printed wiring.

3. The loudspeaker according to claim 2, wherein the back panel is a printed board.

4. The loudspeaker according to claim 1, wherein the back panel further includes a side panel, the side panel is made of a material same as a material of the back panel, and the side panel and the back panel are integrally formed.

5. The loudspeaker according to claim 4, wherein the thin loudspeakers are positioned by being disposed along the side panel.

6. The loudspeaker according to claim 1, wherein the thin loudspeakers are disposed in series in a longitudinal direction of the thin loudspeakers.

7. The loudspeaker according to claim 1, wherein the loudspeaker includes attaching parts near both ends of the back panel for attaching the loudspeaker to a set.

8. Electronic equipment comprising:

a cabinet;

the loudspeaker according to claim 1 contained inside the cabinet; and a signal processing circuit configured to supply an audio signal to the loudspeaker.

9. The electronic equipment according to claim 8, further comprising an image display unit in the cabinet.

10. A mobile device comprising:

a movable main body; and the loudspeaker according to claim 1 incorporated in the main body.

11. A loudspeaker comprising:

a back panel having an aspect ratio of 6 or higher;

thin loudspeakers attached to the back panel and disposed in series in a substantially straight line; and a wiring unit disposed on the back panel and wire-connecting the thin loudspeakers, wherein each of the thin loudspeakers has an outer shape of one of a rectangle, a racetrack shape, and an ellipse, and each of the thin loudspeakers includes:

a frame;

a magnetic circuit connected to the frame and provided with a magnetic gap therein;

a diaphragm attached to a periphery of the frame; and a voice coil having a first end connected to an outer periphery of the diaphragm and a second end disposed in the magnetic gap, wherein each of the thin loudspeakers includes a projection-shaped terminal that projects in a direction opposite to a direction of acoustic emission therefrom and is connected to the wiring unit, the back panel is provided with a hole, and each of the thin loudspeakers is positioned by the terminal being inserted into the hole.

12. The loudspeaker according to claim 11, wherein a printed wiring is placed at a backside of the back panel.

13. The loudspeaker according to claim 12, wherein the terminal pierces through the hole, projects toward a backside of the back panel, and is electrically connected to the printed wiring at the backside.

14. A loudspeaker comprising:

a back panel having an aspect ratio of 6 or higher;

a front panel forming an enclosure together with the back panel;

thin loudspeakers attached to the back panel and disposed in series in a substantially straight line; and a wiring unit disposed on the back panel and wire-connecting the thin loudspeakers, wherein each of the thin loudspeakers has an outer shape of one of a rectangle, a racetrack shape, and an ellipse, and each of the thin loudspeakers includes:

a frame;

a magnetic circuit connected to the frame and provided with a magnetic gap therein;

a diaphragm attached to a periphery of the frame; and a voice coil having a first end connected to an outer periphery of the diaphragm and a second end disposed in the magnetic gap, wherein the thin loudspeakers are fixed by being sandwiched between the front panel and the back panel, and wherein the loudspeaker includes a cushion between the thin loudspeakers and the back panel, the cushion is pressurized and compressed by the thin loudspeakers, and the thin loudspeakers are pressed toward the front panel by an elastic force of the cushion.

* * * * *